US006742448B1

(12) United States Patent
Davis et al.

(10) Patent No.: US 6,742,448 B1
(45) Date of Patent: Jun. 1, 2004

(54) BALER WITH DOORS AND PLATEN POSITIONS INTERLOCKS

(75) Inventors: James Davis, Siloam Springs, AR (US); Gregory W. Staggs, Fayetteville, AR (US)

(73) Assignee: J. U. Manufacturing Co., Inc., Springdale, AR (US)

( * ) Notice: Subject to any disclaimer, the term of this patent is extended or adjusted under 35 U.S.C. 154(b) by 0 days.

(21) Appl. No.: 10/315,338

(22) Filed: Dec. 9, 2002

(51) Int. Cl.[7] ..... B30B 15/06

(52) U.S. Cl. ..... 100/341; 100/50; 100/229 A; 100/342; 100/345

(58) Field of Search ..... 100/45, 48, 50, 100/51, 52, 99, 229 A, 341, 342, 345; 361/144, 160, 166, 179, 192, 193

(56) References Cited

U.S. PATENT DOCUMENTS

| | | | | |
|---|---|---|---|---|
| 3,608,476 A | | 9/1971 | Price | 100/35 |
| 3,802,335 A | | 4/1974 | Longo | 100/35 |
| 3,903,461 A | * | 9/1975 | Waggoner | 361/189 |
| 3,962,964 A | * | 6/1976 | Engebretsen | 100/51 |
| 4,007,677 A | * | 2/1977 | Fox | 100/45 |
| 4,232,599 A | | 11/1980 | Ulrich | 100/25 |
| 4,266,174 A | * | 5/1981 | Miller et al. | 318/753 |
| 4,643,087 A | | 2/1987 | Fenner et al. | 100/35 |
| 4,953,109 A | | 8/1990 | Burgis | 364/550 |
| 5,016,197 A | | 5/1991 | Neumann et al. | 364/550 |
| 5,285,721 A | * | 2/1994 | Sugimoto et al. | 100/43 |
| 5,558,013 A | | 9/1996 | Blackstone, Jr. | 100/35 |
| 5,751,532 A | | 5/1998 | Kanuchok et al. | 361/94 |
| 5,773,945 A | | 6/1998 | Kim et al. | 318/434 |
| 6,055,902 A | | 5/2000 | Harrop et al. | 100/52 |

* cited by examiner

*Primary Examiner*—Ed Tolan
(74) *Attorney, Agent, or Firm*—Robert R. Keegan; Treut C. Keisling; David B. Pieper

(57) ABSTRACT

There is disclosed a baler for paper recycling having a control system responsive to switches and digital timers, and an electromagnetic interlock coupling a loading door and a chamber door, said control system including a programmable relay having outputs to motor starter, control valves, and electromagnetic interlock. A mode selection switch enables automatic, manual down, and manual up modes, the latter of which is used to eject a bale. The electromagnetic interlock performs multiple functions reducing the number of components needed in the system, improving reliability and reducing maintenance.

15 Claims, 8 Drawing Sheets

BALER WITH DOORS AND PLATEN POSITIONS INTERLOCKS

BACKGROUND OF THE INVENTION

Cross Reference to Related Application

None.

Field of the Invention

The present invention relates to compaction apparatus, particularly waste paper balers and to control apparatus therefor responsive to timers and to chamber door, loading door, and/or platen position sensors for detecting possible unsafe operation of the baler and for disabling or otherwise preventing hazardous operation modes.

SUMMARY OF THE INVENTION

The present invention relates to compaction equipment for commercial and industrial trash compaction and waste paper baler equipment utilized in paper recycling, which are important and widely used tools in the field of waste management. It is very desirable that this equipment be both efficient and reliable. As with all powerful mechanical equipment, safety hazards should be eliminated to the maximum extent possible, recognizing that there is a tendency for human operators to be less careful than they should be.

Although the invention with which this application is concerned is particularly useful in waste paper balers, this background discussion also concerns itself with trash compactors, since they are both widely used and common forms of equipment. The detailed description below will fully describe balers incorporating the invention. The commercial or industrial waste compactor or baler which will be referred to herein as a "compactor" is found in many situations where there are large volumes of waste to be disposed of in landfills or baled for recycling. Thus, compactors including waste compactors and balers are found in shopping centers, industrial complexes, associated with large discount stores or department stores, and in some residential complexes.

The operation and control of balers according to the invention includes features for controlling the starting, stopping, and reversing of the ram used for driving the platen and compressing the waste paper (usually corrugated paper board from packages and cartons). Features such as interlocks and fault detection functions are included which are important to promote and ensure safety at the point of operation of such powerful mechanical equipment.

Although operational control of compaction apparatus in years past was usually implemented by simple switches and relays, there has been a tendency in recent years to employ computer microprocessors and somewhat sophisticated computer programs and algorithms stored in computer memory in, or associated with, the microprocessor.

U.S. Pat. No. 4,953,109 to Burgis, Pat. No. 5,016,197 to Neumann, et al., and U.S. Pat. No. 5,558,013 to Blackstone, Jr. are examples of trash compaction systems utilizing rather complex computer programs to implement the desired control system (including fullness determination in compaction apparatus). These may be compared with U.S. Pat. No. 3,802,335 to Longo, Pat. No. 4,643,087 to Fenner, et al., and U.S. Pat. No. 6,055,902 to Harrop, et al., which do not employ computer microprocessors but execute simple logic with electrical relays.

Compactors including waste compactors and balers are typically exposed to harsh environments including wide ranges of temperatures and potential exposure to power surges. In addition, it is very important that the compaction equipment operate reliably and operate in a safe manner and not be subject to malfunction because of failure or error conditions in its electrical controls. For that reason, there are many users and others who consider that a relatively simply relay based control system has advantages with regard to reliability, durability, and safety over microprocessor controlled by complex software.

Compactors of the present invention have advantages of simple electro-mechanical related based control systems as shown in U.S. Pat. No. 6,055,902, disclosure of which is incorporated herein by reference, and at the same time provide an advantage of simple maintainability and low component cost that previous electro-mechanical related based control systems do not provide.

Included in the operating and control system are combination magnetic locks and position sensors which operate effectively for locking, releasing, and sensing the position of the loading door and the bale chamber door while reducing the total number of sensors and/or interlocks needed in the system.

The present invention departs from the teaching of prior art waste baler paper systems by providing apparatus which is simple, durable, reliable, and capable of being programmed with special features and which provides safe and uncomplicated operation for operating personnel. An important feature of the present invention is the employment of programmable electronic relay networks in a manner to achieve the simplicity and reliability of electrical relay based control systems while achieving the flexibility, programmability, and reduced component costs associated with electro-mechanical relay or solid state relay control networks.

In addition to providing the features and advantages referred to above, it is an object of the present invention to provide compaction apparatus such as waste paper balers which have the advantages of simple relay-implemented control systems including a safety interlock feature for the bale chamber door, and the loading door while obtaining the advantages of programming flexibility, increased reliability, and reduced component costs.

It is another object of the present invention to utilize combination electromagnetic lock and sensor units for providing control signals to the programmable relay network and receiving control signals from the programmable relay network, thereby reducing the mechanical and electrical elements associated with the control system.

It is yet another object of the present invention to provide waste paper balers with controls utilizing programmable relay networks for timing functions which would otherwise require separate timing elements with less adjustability, greater cost, and greater assembly expense.

It is a further object of the present invention to provide a programmable relay control system for waste paper balers which maximizes simplicity of operation while assuring that electromagnetic interlocks and other safety features prevent improper or unintended operation which could cause property damage or personal injury.

In addition to the features and advantages of the baler apparatus according to the invention described above, further advantages thereof will be apparent from the following description in conjunction with the appended drawings.

DETAILED DESCRIPTION OF THE PREFERRED EMBODIMENTS

PREFERRED EMBODIMENTS

Figure 1:
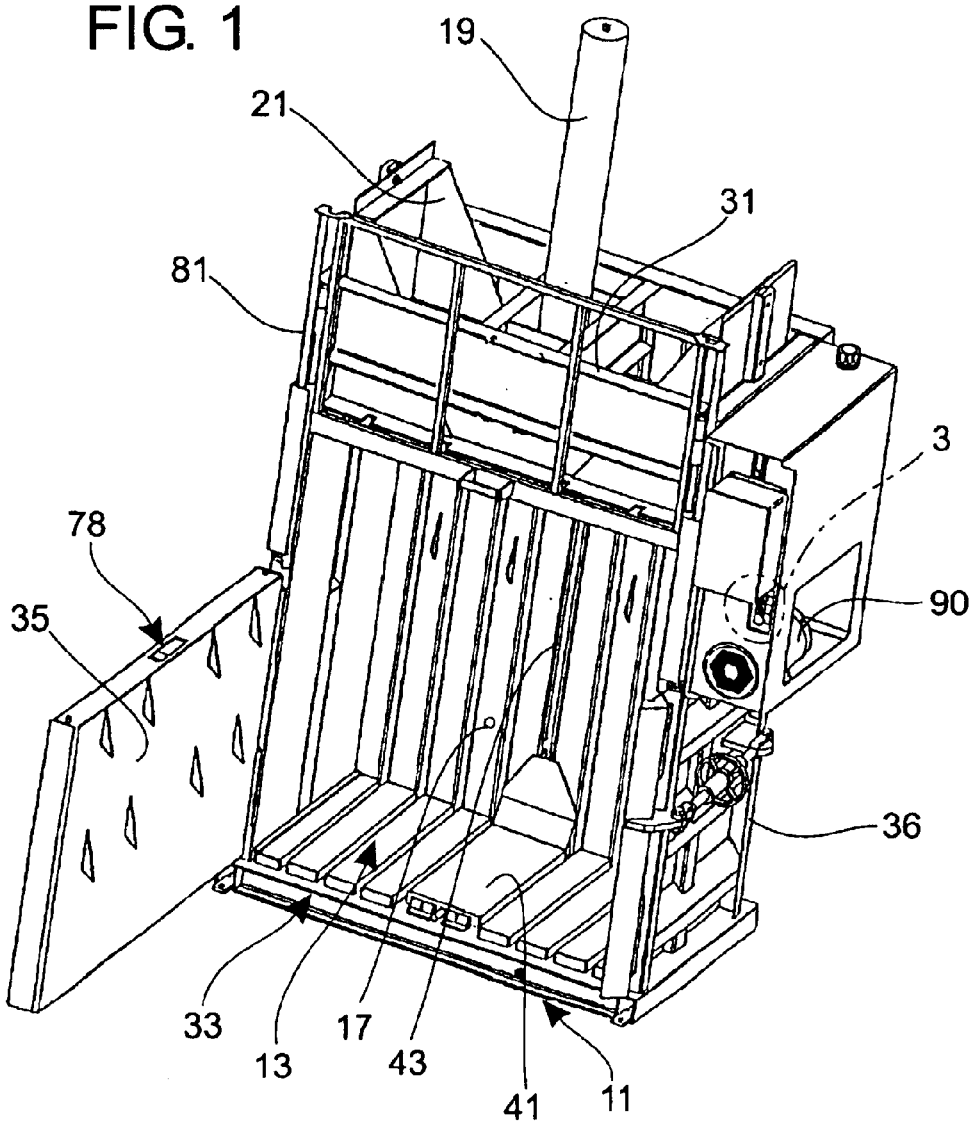
FIG. 1 is an isometric view of a baler according to the present invention.
Figure 3:
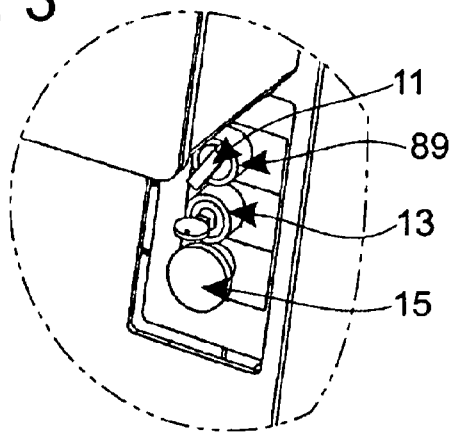
FIG. 3 is an enlarged view of the control panel from FIG. 1.
Figure 2:
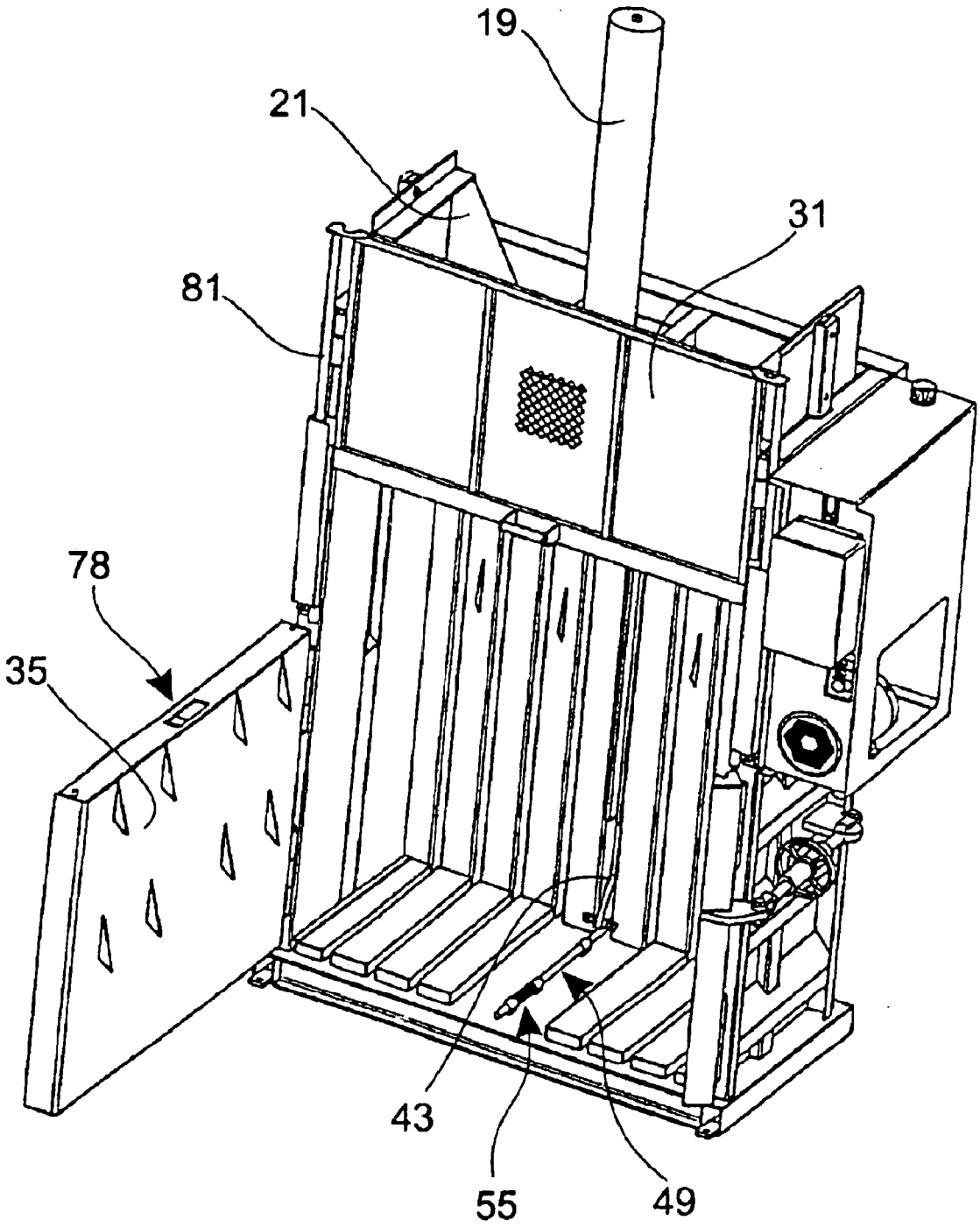
FIG. 2 is an isometric view of the apparatus of FIG. 1 broken away to show functional elements thereof.
Figure 4A:
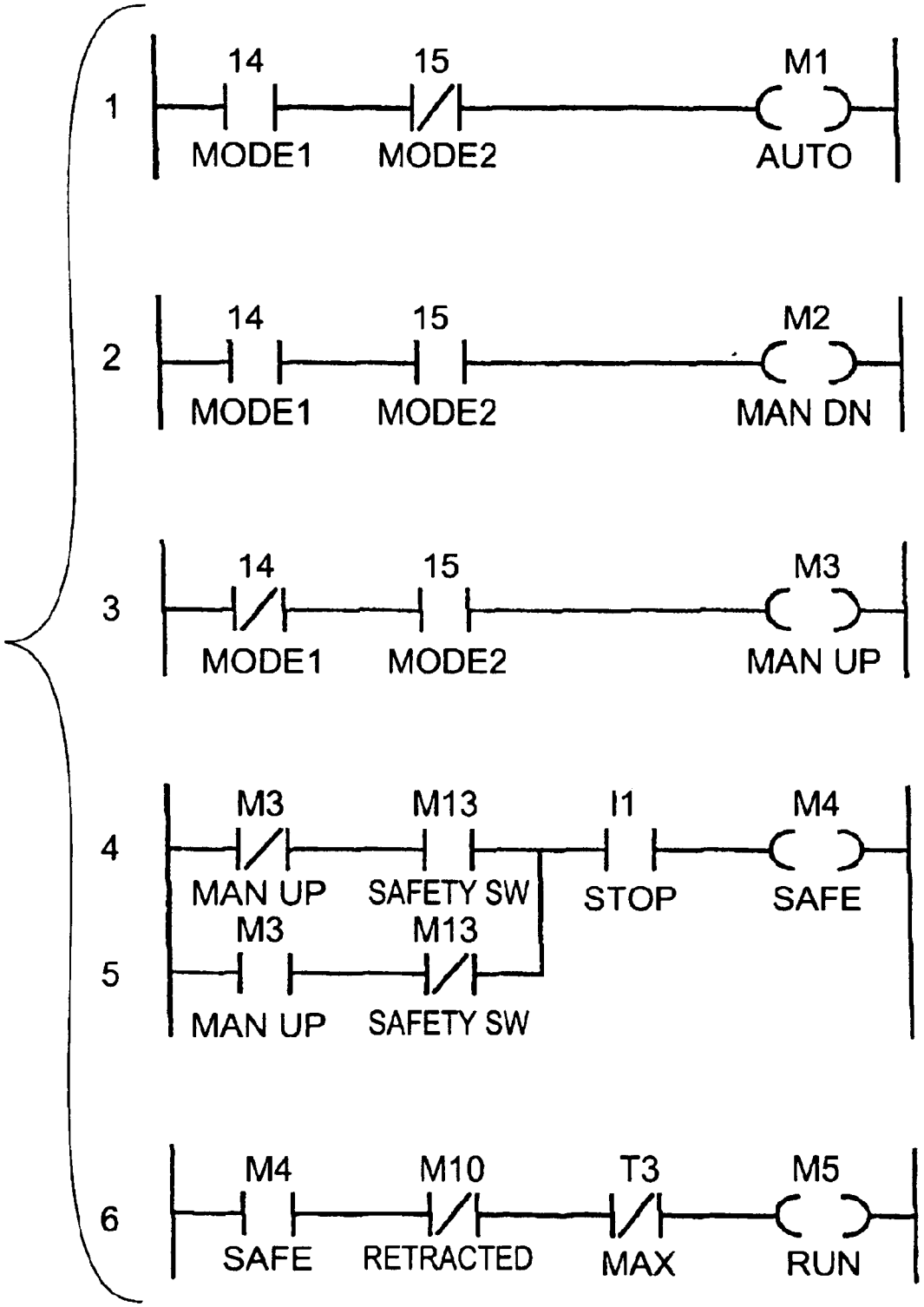
FIGS. 4A through 4E is a diagram of one embodiment of programmable relay configuration for controlling the baler of FIGS. 1 and 2.
Figure 4B:
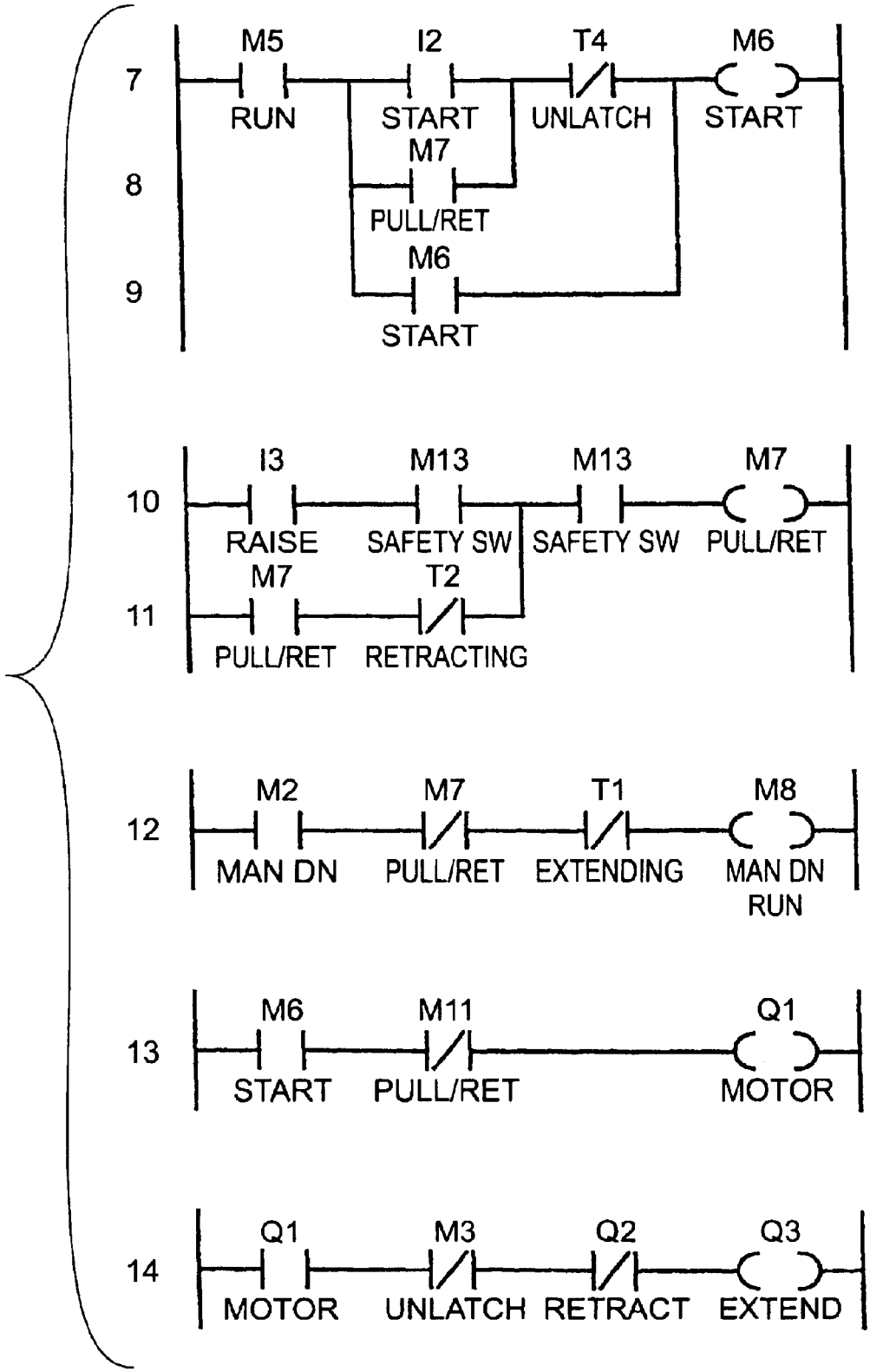
Figure 4C:
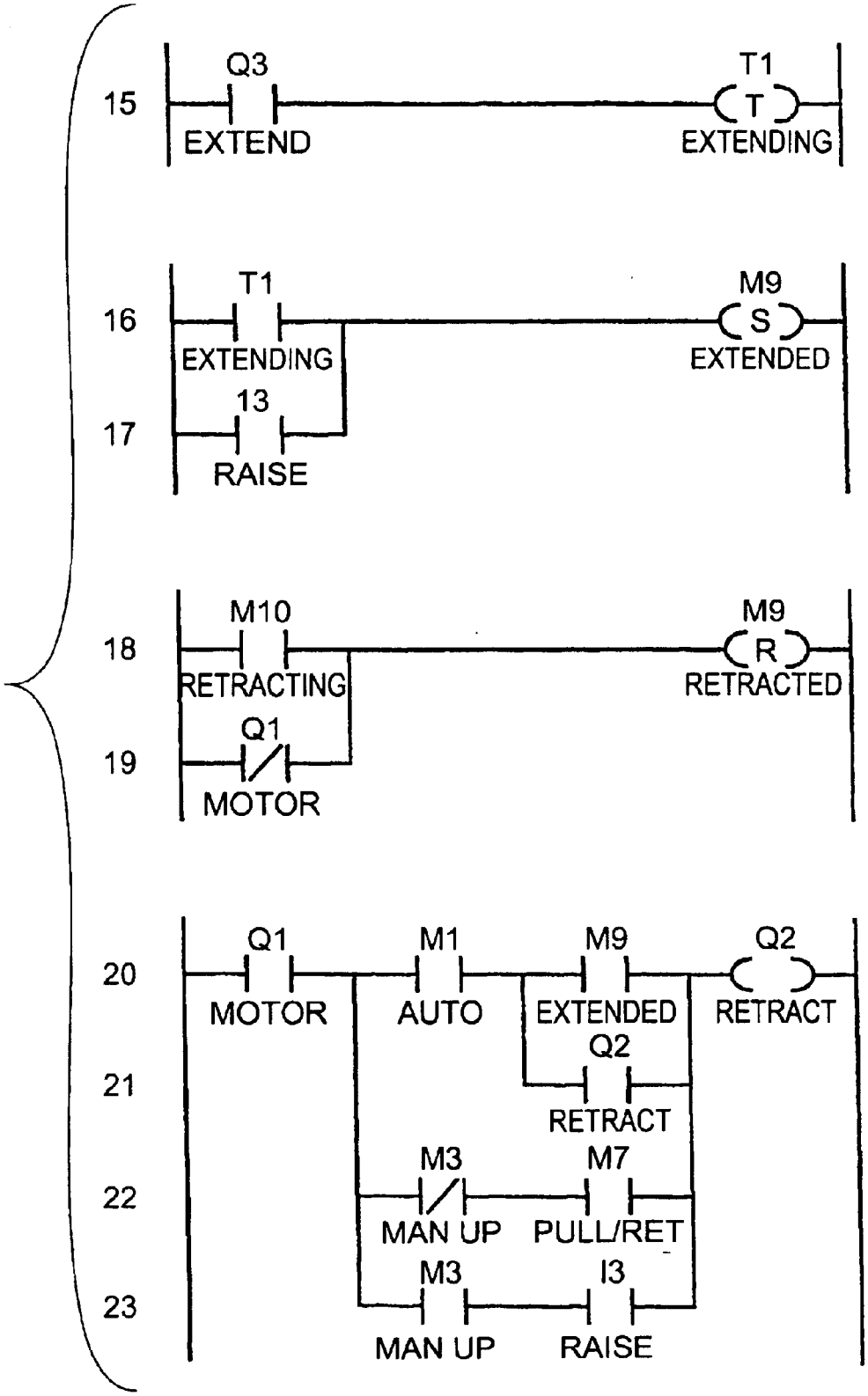
Figure 4D:
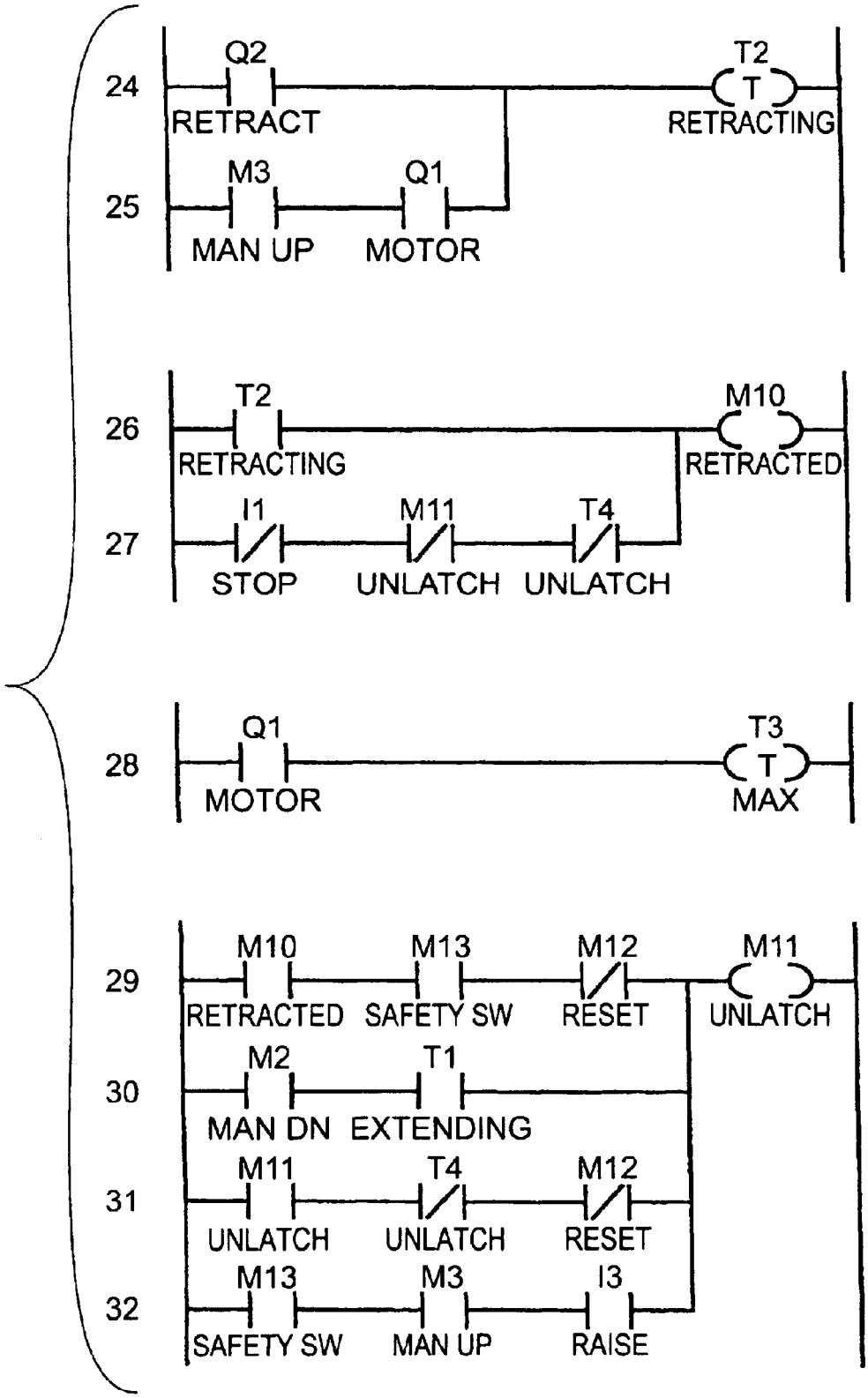
Figure 4E:
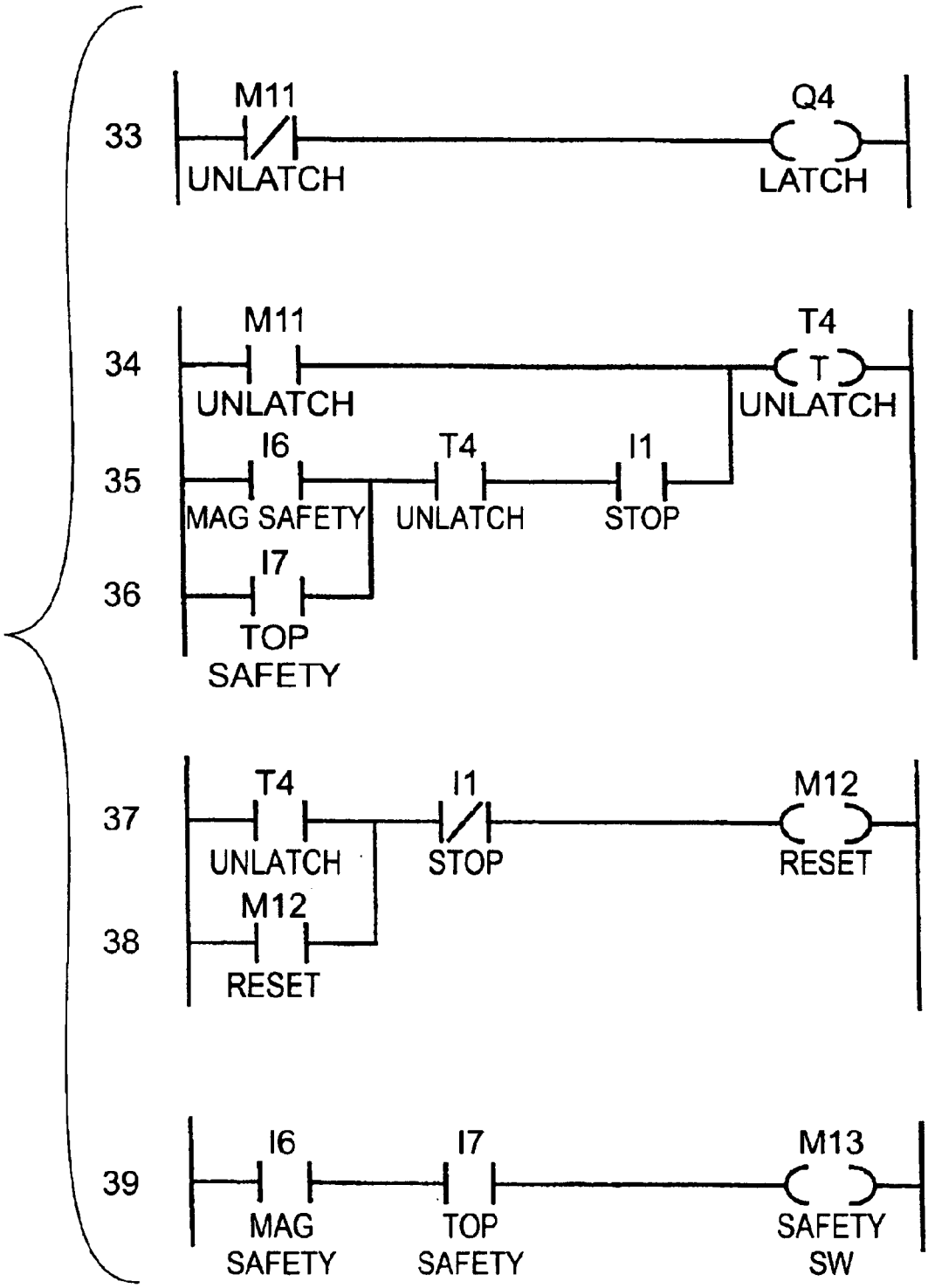

Referring to FIGS. 1, 2, and 3, a baler 11 according to the invention is shown having a bale chamber 13 to receive waste which is to be compacted. Hydraulic ram 19 of conventional construction serves to raise and lower a platen 21 to provide the compressing force on the waste material for compaction. A loading door 31 slides in vertical tracks to provide a closeable opening for loading waste into the chamber 13. In FIG. 1, door 31 is broken away to show the structure behind it but door 31 is shown in its entirety in FIG. 2.

Preferably the loading door 31 is not simply provided with a counterweight and cable mechanism to make it easy to manually raise, but it is rather provided with a gas springs 81 one of conventional form, on each side with characteristics appropriate to overcome the weight of the door and raise it to the upward position at any time when it is not engaged by interlock 78. Gas spring 81 is a readily available component, used extensively, in the automotive industry for example, and is manufactured by Industrial Gas Springs Ltd and others. Preferably, the gas springs 81 are damped gas springs configured with the loading door 31 so that when it is released from the electromagnetic interlock 78, it will raise at moderate speed smoothly and softly upward to its fully opened position. While the gas spring arrangement for the loading door is a very desirable feature, the system would be fully operative with some other damped or undamped counterweight or spring arrangement as known in the art.

Unloading opening 33 at the front of the baler 11 is closed by a chamber door 35 having a lock 36. It is opened when it is desired to access a bale for tying and/or for ejecting it. A dump tray 41 in the bottom of the baler chamber is pivoted at its front edge and allowed to rotate up and forwardly to cause ejection of a finished bale. In the center of back 17 of the baler 11 is a vertically extending dump link bar 43 permanently engaged to the platen 21 to move therewith and selectively engageable with the dump tray 41. In FIG. 2 the baler 11 is shown with the dump tray 41 broken away to show a dump control link 49 extending fore and aft at the bottom of the dump tray 41. Control link 49 causes the dump tray 41 to be engaged by the dump link bar 43 (but only when dump link bar 43 is allowed to assume a forward with door 35 not closed). Spring 55 on control link 49 serves to urge it forward except when door 35 is closed.

From the foregoing description, it will be seen that the dump tray 41 is inactive so long as door 35 is closed, but may be raised by the hydraulic ram to eject a bale due to being coupled to platen 21 when door 35 is closed. Other known embodiments of bale ejection apparatus or as shown in prior patents could be employed with the control apparatus rather than using the preferred embodiment shown and described above.

An enlarged view of the preferred control panel arrangement for the apparatus is shown in FIG. 3. A mode selector switch for selecting manual up, manual down, and auto modes of operation is shown at 71. The function of this switch will be described more fully hereinafter. An off/on/start key switch 73 is positioned below the mode selector switch 71. A key switch is provided to give control over authorization to operate the baler. Other access control devices such as biometric controls and magnetic card readers could also be used for operator access control for the baler. Electrical operation of switch 73 is more fully explained below.

Below the key switch 73 is a stop/pull to raise button 75. In addition to serving as an emergency stop switch the stop/pull to raise button 75 serves as the control for manually raising the platen to eject a finished bale. It must be manually pulled out and held by an operator for that operation. This is a safety feature that will be further explained in connection with the control system for the baler. A power on light 89 in this preferred embodiment is associated with the mode selector switch 71 but this is an optional feature and a different form of power on light could be provided if desired.

Key switch 73, among other things, controls the motor with motor starter 90 which provides power for hydraulic ram 19. The hydraulic system and valves therefor are conventional and their function will be understood by those skilled in the art so that the details thereof are not shown. In the interest of clarity, details of well known elements of balers and other compaction equipment are not shown and described.

The programmable controller for the baler 11 preferably takes the form of a programmable relay 61 (shown in FIG. 5) utilizing relay ladder logic as shown in FIGS. 4A through 4E. For an explanation of relay ladder logic processors refer to U.S. Pat. No. 5,777,869, issued Jul. 7, 1998 to Welch and U.S. Pat. No. 6,018,797, issued Jan. 25, 2000 to Schmidt, et al., incorporated herein by reference, and to the references cited in those patents. A very brief explanation of ladder logic processors will be helpful in describing FIGS. 4A through 4E. As seen in FIGS. 4A through 4E, ladder logic programming, as expected, looks like a ladder. It probably has more similarities to a flow chart than the usual multi-line computer program. There are two vertical lines coming down the program chart, one on the left and one on the right. "Rungs" between the lines have conditionals on the left that lead to outputs on the right as will be apparent in FIGS. 4A through 4E. The most used elements in ladder logic are the relay conditionals –| |– and –/– and the output coils –( )–. The relay conditional with a space means "closed only if energized" while the relay conditional with the slash means "closed if not energized." The output coil generally means "if its relay is closed energize this output element."

The delay timing notations and other notations in the ladder logic chart of FIGS. 4A through E are self-explanatory. Ladder rung numbers appear at the right margin.

The operation of the baler control system will be explained first for the "AUTO" mode.

The conditions for the initial set-up are:

- Mode selector switch 71 is in the center position for "AUTO" mode;
- Key switch 73 is in the center position for "POWER ON";
- Stop button 75 is in the center position for normal operation;
- Baler chamber door 35 is closed and latched;
- Platen 21 is fully retracted;

Loading door 31 is open;

Electromagnetic interlock 78 is energized.

The software under which the ladder logic program runs operates in a scanning mode with a scan cycle on the order of ten milliseconds. The program status of the ladder logic program at set-up is as follows.

Set-up Program:

Rung 1, I4 closed, I5 closed, M1 energized
Rung 2, I4 open, I5 closed, M2 not energized
Rung 3, I4 closed, I5 open, M3 not energized
Rung 4, M3 closed, I8 open, I1 closed, M4 not energized
Rung 5, M3 open, I8 closed
Rung 6, M4 open, M10 closed, T3 closed, M5 not energized
Rung 7, M5 open, I2 open, T4 closed, M6 not energized
Rung 8, M7 open
Rung 9, M6 open, I7 open
Rung 10, M3 open
Rung 11, I3 open, I8 open, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 closed, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 closed, T4 closed
Rung 29, Q1 open, T3 not energized
Rung 30, M10 open, I8 open, M12 closed, M11 not energized
Rung 31, M2 open, T1 open
Rung 32, M11 open, T4 closed, M12 closed
Rung 33, I8 open, M3 open, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open For transition to the initial operation mode, the loading door 31 is closed and when the striking plate 79 closes with the electromagnetic interlock 78 the loading door 31 locks. The status of the ladder logic program then becomes AUTO READY OPERATION PROGRAM:

Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 not energized
Rung 8, M7 open
Rung 9, M6 open, I7 open
Rung 10, M3 open
Rung 11, I3 open, I8 closed, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 closed, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 closed, T4 closed
Rung 29, Q1 open, T3 not energized
Rung 30, M10 open, I8 closed, M12 closed, M11 not energized
Rung 31, M2 open, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 open
Rung 38, T4 open, I1 open, M12 not energized
Rung 39, M12 open For start operation, the key switch is turned to the right to the "START" position causing the motor powering the hydraulic ram 19 to start and the platen 21 to begin its descent. The ladder logic program status then becomes AUTO START OPERATION PROGRAM:

Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 closed, T4 closed, M6 energized
Rung 8, M7 open
Rung 9, M6 closed, I7 open
Rung 10, M3 open
Rung 11, I3 open, I8 closed, I7 open, M7 not energized
Rung 12, M7 open, I7 open
Rung 13, M6 closed, M11 closed, Q1 energized
Rung 14, Q1 closed, M3 closed, Q4 closed, Q3 energized
Rung 15, Q3 closed, T1 energized (timing)
Rung 16, T1 open, M9 (S) not energized
Rung 17, I3 open Rung 18, M10 open, M9 (R) not energized Rung 19, Q1 open Rung 20, Q1 closed, M1 closed, M9 open, Q4 not energized Rung 21, Q4 open Rung 22, M3 closed, M7 open Rung 23, M3 open, I3 open Rung 24, Q4 open, T2 not energized Rung 25, M3 open, Q1 closed Rung 26, T2 open, M10 not energized Rung 27, I7 open, Q4 open, M3 closed Rung 28, I1 open, M11 closed, T4 closed Rung 29, Q1 closed, T3 energized (timing)

Rung 30, M10 open, I8 closed, M12 closed, M11 not energized

Rung 31, M2 open, T1 open

Rung 32, M11 open, T4 closed, M12 closed

Rung 33, I8 closed, M3 open, I3 open

Rung 34, M11 closed, Q2 energized

Rung 35, M11 open, T4 not energized

Rung 36, I8 closed, T4 open, I1 closed

Rung 37, I7 open

Rung 38, T4 open, I1 open, M12 not energized

Rung 39, M12 open

In the descending operation the safety interlock switch 78 will close as the platen 21 descends about three inches and the key switch 73 should by then be released to return to the center or "POWER ON" position. The status in descent operation is:

DESCENT OPERATION PROGRAM:

Rung 1, I4 closed, I5 closed, M1 energized

Rung 2, I4 open, I5 closed, M2 not energized

Rung 3, I4 closed, I5 open, M3 not energized

Rung 4, M3 closed, I8 closed, I1 closed, M4 energized

Rung 5, M3 open, I8 open

Rung 6, M4 closed, M10 closed, T3 closed, M5 energized

Rung 7, M5 closed, I2 open, T4 closed, M6 energized

Rung 8, M7 open

Rung 9, M6 closed, I7 closed

Rung 10, M3 open

Rung 11, I3 open, I8 closed, I7 closed, M7 not energized

Rung 12, M7 open, I7 closed

Rung 13, M6 closed, M11 closed, Q1 energized

Rung 14, Q1 closed, M3 closed, Q4 closed, Q3 energized

Rung 15, Q3 closed, T1 energized (timing)

Rung 16, T1 open, M9 (S) not energized

Rung 17, I3 open

Rung 18, M10 open, M9 (R) not energized

Rung 19, Q1 open

Rung 20, Q1 closed, M1 closed, M9 open, Q4 not energized

Rung 21, Q4 open

Rung 22, M3 closed, M7 open

Rung 23, M3 open, I3 open

Rung 24, Q4 open, T2 not energized

Rung 25, M3 open, Q1 closed

Rung 26, T2 open, M10 not energized

Rung 27, I7 open, Q4 open, M3 closed

Rung 28, I1 open, M11 closed, T4 closed

Rung 29, Q1 closed, T3 energized (timing)

Rung 30, M10 open, I8 closed, M12 closed, M11 not energized

Rung 31, M2 open, T1 open

Rung 32, M11 open, T4 closed, M12 closed

Rung 33, I8 closed, M3 open, I3 open

Rung 34, M11 closed, Q2 energized

Rung 35, M11 open, T4 not energized

Rung 36, I8 closed, T4 open, I1 closed

Rung 37, I7 closed

Rung 38, T4 open, I1 open, M12 not energized

Rung 39, M12 open

The platen 21 will continue to be in the descend mode until the accumulated extend time is equal to the preset value of the extend timer, at which time the platen 21 will start retracting. Since this operation is a matter of timing only, the time during which the force of the platen is applied to compact the trash may vary somewhat. The ladder logic program status for retract operation is:

RETRACT OPERATION PROGRAM:

Rung 1, I4 closed, I5 closed, M1 energized

Rung 2, I4 open, I5 closed, M2 not energized

Rung 3, I4 closed, I5 open, M3 not energized

Rung 4, M3 closed, I8 closed, I1 closed, M4 energized

Rung 5, M3 open, I8 open

Rung 6, M4 closed, M10 closed, T3 closed, M5 energized

Rung 7, M5 closed, I2 open, T4 closed, M6 energized

Rung 8, M7 open

Rung 9, M6 closed, I7 closed

Rung 10, M3 open

Rung 11, I3 open, I8 closed, I7 closed, M7 not energized

Rung 12, M7 open, I7 closed

Rung 13, M6 closed, M11 closed, Q1 energized

Rung 14, Q1 closed, M3 closed, Q4 open, Q3 not energized

Rung 15, Q3 open, T1 (timed out) (not energized)

Rung 16, T1 closed, M9 (S) energized, T1 returns to open, M9 (S) not energized Rung 17, I3 open Rung 18, M10 open, M9 (R) not energized Rung 19, Q1 open Rung 20, Q1 closed, M1 closed, M9 closed, Q4 energized Rung 21, Q4 closed Rung 22, M3 closed, M7 open Rung 23, M3 open, I3 open Rung 24, Q4 closed, T2 energized (timing)

Rung 25, M3 open, Q1 closed

Rung 26, T2 open, M10 not energized

Rung 27, I7 open, Q4 closed, M3 closed

Rung 28, I1 open, M11 closed, T4 closed

Rung 29, Q1 closed, T3 energized (timing)

Rung 30, M10 open, I8 closed, M12 closed, M11 not energized

Rung 31, M2 open, T1 closed, T1 returns to open

Rung 32, M11 open, T4 closed, M12 closed

Rung 33, I8 closed, M3 open, I3 open

Rung 34, M11 closed, Q2 energized

Rung 35, M11 open, T4 not energized

Rung 36, I8 closed, T4 open, I1 closed

Rung 37, I7 closed

Rung 38, T4 open, I1 open, M12 not energized

Rung 39, M12 open

The platen 21 will retract until it moves to open the safety interlock 78 or when the accumulated retract time is equal to the preset value in the retract timer. In either case, the motor powering the ram 19 will stop and the electromagnetic interlock 78 will de-energize for three seconds to unlock the loading door 31 allowing it to open. The ladder logic program status is as follows:

RETRACT OPERATION PROGRAM:

Rung 1, I4 closed, I5 closed, M1 energized

Rung 2, I4 open, I5 closed, M2 not energized

Rung 3, I4 closed, I5 open, M3 not energized

Rung 4, M3 closed, I8 closed, I1 closed, M4 energized

Rung 5, M3 open, I8 open

Rung 6, M4 closed, M10 open, T3 closed, M5 not energized, M10 returns to closed, M5 energized Rung 7, M5 open, I2 open, T4 closed, M6 not energized, M5 returns to closed Rung 8, M7 open Rung 9, M6 open, I7 open Rung 10, M3 open Rung 11, I3 open, I8 closed, I7 open, M7 not energized Rung 12, M7 open, I7 open Rung 13, M6 open, M11 open, Q1 not energized Rung 14, Q1 open, M3 closed, Q4 closed, Q3 not energized Rung 15, Q3 open, T1 not energized Rung 16, T1 open, M9 (S) not energized Rung 17, I3 open Rung 18, M10 closed, M9 (R) energized, M10 returns to open Rung 19, Q1 closed Rung 20, Q1 open, M1 closed, M9 open, Q4 not energized Rung 21, Q4 open Rung 22, M3 closed, M7 open Rung 23, M3 open, I3 open Rung 24, Q4 open, T2 not energized (timed out)

Rung 25, M3 open, Q1 open

Rung 26, T2 closed, M10 energized, T2 returns to open, M10 not energized Rung 27, I7 closed, Q4 open, M3 closed Rung 28, I1 open, M11 open, T4 closed Rung 29, Q1 open, T3 not energized Rung 30, M10 closed, I8 closed, M12 closed, M11 energized, M10 returns to open Rung 31, M2 open, T1 open Rung 32, M11 closed, T4 closed, M12 closed Rung 33, I8 closed, M3 open, I3 open Rung 34, M11 open, Q2 not energized Rung 35, M11 closed, T4 energized (timing)

Rung 36, I8 closed, T4 open, I1 closed

Rung 37, I7 open

Rung 38, T4 open, I1 open, M12 not energized

Rung 39, M12 open

After the loading door opening mechanism opens the loading door 31, the electromagnetic interlock 78 will re-energize. The ladder logic program status will be:

END OPERATION MODE PROGRAM:

Rung 1, I4 closed, I5 closed, M1 energized

Rung 2, I4 open, I5 closed, M2 not energized

Rung 3, I4 closed, I5 open, M3 not energized

Rung 4, M3 closed, I8 open, I1 closed, M4 not energized

Rung 5, M3 open, I8 closed

Rung 6, M4 open, M10 closed, T3 closed, M5 not energized

Rung 7, M5 open, I2 open, T4 closed, M6 not energized

Rung 8, M7 open

Rung 9, M6 open, I7 open

Rung 10, M3 open

Rung 11, I3 open, I8 open, I7 open, M7 not energized

Rung 12, M7 open, I7 open

Rung 13, M6 open, M11 closed, Q1 not energized

Rung 14, Q1 open, M3 closed, Q4 closed, Q3 not energized

Rung 15, Q3 open, T1 not energized

Rung 16, T1 open, M9 (S) not energized

Rung 17, I3 open

Rung 18, M10 open, M9 (R) energized

Rung 19, Q1 closed

Rung 20, Q1 open, M1 closed, M9 open, Q4 not energized

Rung 21, Q4 open

Rung 22, M3 closed, M7 open

Rung 23, M3 open, I3 open

Rung 24, Q4 open, T2 not energized

Rung 25, M3 open, Q1 open

Rung 26, T2 open, M10 not energized

Rung 27, I7 closed, Q4 open, M3 closed

Rung 28, I1 open, M11 open, T4 closed, M11 returns to closed Rung 29, Q1 open, T3 not energized Rung 30, M10 open, I8 open, M12 closed, M11 not energized Rung 31, M2 open, T1 open Rung 32, M11 open, T4 open, M12 closed, T4 returns to closed Rung 33, I8 open, M3 open, I3 open Rung 34, M11 closed, Q2 energized Rung 35, M11 open, T4 not energized (timed out)

Rung 36, I8 open, T4 closed, I1 closed, T4 returns to open

Rung 37, I7 open

Rung 38, T4 closed, I1 open, M12 not energized, T4 returns to open Rung 39, M12 open The "AUTO" operation described above is that which would be used in accumulating waste and compacting it in a series of operations to form a bale.

The "MANUAL DOWN" mode of operation described below is used when such is desired, particularly when sufficient waste has been accumulated and compacted to form a bale, so that it can be removed from the baler. The set-up conditions for the "MANUAL DOWN" mode of operation are as follows:

Mode selector switch 71 is in the 60 degree down position for "MANUAL DOWN" mode.

The key switch is in the center position for "POWER ON".

The stop button 75 is in the center position for normal operation.

The baler chamber door 35 is closed and latched.

The platen 21 is fully retracted.

The loading door 31 is open.

The electromagnetic interlock 78 is energized.

The set-up status for the ladder logic program is MANUAL DOWN SETUP PROGRAM:

Rung 1, I4 open, I5 closed, M1 not energized

Rung 2, I4 closed, I5 closed, M2 energized

Rung 3, I4 open, I5 open, M3 not energized

Rung 4, M3 closed, I8 open, I1 closed, M4 not energized

Rung 5, M3 open, I8 closed

Rung 6, M4 open, M10 closed, T3 closed, M5 not energized

Rung 7, M5 open, I2 open, T4 closed, M6 not energized

Rung 8, M7 open

Rung 9, M6 open, I7 open

Rung 10, M3 open

Rung 11, I3 open, I8 open, I7 open, M7 not energized

Rung 12, M7 open, I7 open

Rung 13, M6 open, M11 closed, Q1 not energized

Rung 14, Q1 open, M3 closed, Q4 closed, Q3 not energized

Rung 15, Q3 open, T1 not energized

Rung 16, T1 open, M9 (S) not energized

Rung 17, I3 open

Rung 18, M10 open, M9 (R) energized

Rung 19, Q1 closed

Rung 20, Q1 open, M1 open, M9 open, Q4 not energized

Rung 21, Q4 open

Rung 22, M3 closed, M7 open

Rung 23, M3 open, I3 open

Rung 24, Q4 open, T2 not energized

Rung 25, M3 open, Q1 open

Rung 26, T2 open, M10 not energized

Rung 27, I7 closed, Q4 open, M3 closed

Rung 28, I1 open, M11 closed, T4 closed

Rung 29, Q1 open, T3 not energized

Rung 30, M10 open, I8 open, M12 closed, M11 not energized

Rung 31, M2 closed, T1 open

Rung 32, M11 open, T4 closed, M12 closed

Rung 33, I8 open, M3 open, I3 open

Rung 34, M11 closed, Q2 energized

Rung 35, M11 open, T4 not energized

Rung 36, I8 open, T4 open, I1 closed

Rung 37, I7 open

Rung 38, T4 open, I1 open, M12 not energized

Rung 39, M12 open

Preliminary to starting the MANUAL DOWN operation, the loading door 31 is closed. When striking plate 79 closes with the electromagnetic interlock 78, the loading door 31 locks. The ladder logic program status is START MANUAL DOWN PROGRAM:

Rung 1, I4 open, I5 closed, M1 not energized

Rung 2, I4 closed, I5 closed, M2 energized

Rung 3, I4 open, I5 open, M3 not energized

Rung 4, M3 closed, I8 closed, I1 closed, M4 energized

Rung 5, M3 open, I8 open

Rung 6, M4 closed, M10 closed, T3 closed, M5 energized

Rung 7, M5 closed, I2 open, T4 closed, M6 not energized

Rung 8, M7 open

Rung 9, M6 open, I7 open

Rung 10, M3 open

Rung 11, I3 open, I8 open, I7 open, M7 not energized

Rung 12, M7 open, I7 open

Rung 13, M6 open, M11 closed, Q1 not energized

Rung 14, Q1 open, M3 closed, Q4 closed, Q3 not energized

Rung 15, Q3 open, T1 not energized

Rung 16, T1 open, M9 (S) not energized

Rung 17, I3 open

Rung 18, M10 open, M9 (R) energized

Rung 19, Q1 closed

Rung 20, Q1 open, M1 open, M9 open, Q4 not energized

Rung 21, Q4 open

Rung 22, M3 closed, M7 open

Rung 23, M3 open, I3 open

Rung 24, Q4 open, T2 not energized

Rung 25, M3 open, Q1 open

Rung 26, T2 open, M10 not energized

Rung 27, I7 closed, Q4 open, M3 closed

Rung 28, I1 open, M11 closed, T4 closed

Rung 29, Q1 open, T3 not energized

Rung 30, M10 open, I8 closed, M12 closed, M11 not energized

Rung 31, M2 closed, T1 open

Rung 32, M11 open, T4 closed, M12 closed

Rung 33, I8 closed, M3 open, I3 open

Rung 34, M11 closed, Q2 energized

Rung 35, M11 open, T4 not energized

Rung 36, I8 closed, T4 open, I1 closed

Rung 37, I7 open

Rung 38, T4 open, I1 open, M12 not energized

Rung 39, M12 open

For MANUAL DOWN START operation, the key switch 73 is turned to the right to the "START" position causing the motor powering the hydraulic ram 19 to start and the platen 21 to begin its descent. The ladder logic program status then becomes:

START MANUAL DOWN OPERATION PROGRAM:

Rung 1, I4 open, I5 closed, M1 not energized

Rung 2, I4 closed, I5 closed, M2 energized

Rung 3, I4 open, I5 open, M3 not energized

Rung 4, M3 closed, I8 closed, I1 closed, M4 energized

Rung 5, M3 open, I8 open

Rung 6, M4 closed, M10 closed, T3 closed, M5 energized

Rung 7, M5 closed, I2 closed, T4 closed, M6 energized

Rung 8, M7 open

Rung 9, M6 closed, I7 open

Rung 10, M3 open

Rung 11, I3 open, I8 closed, I7 open, M7 not energized

Rung 12, M7 open, I7 open

Rung 13, M6 closed, M11 closed, Q1 energized

Rung 14, Q1 closed, M3 closed, Q4 closed, Q3 energized

Rung 15, Q3 closed, T1 energized (timing)

Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 closed
Rung 26, T2 open, M10 not energized
Rung 27, I7 closed, Q4 open, M3 closed
Rung 28, I1 open, M11 closed, T4 closed
Rung 29, Q1 closed, T3 energized (timing)
Rung 30, M10 open, I8 closed, M12 closed, M11 not energized
Rung 31, M2 closed, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 open
Rung 38, T4 open, I1 open, M12 not energized
Rung 39, M12 open In the descending operation, the safety interlocks switch 78 will close as the platen 21 descends about three inches and the key switch 73 should by then be released to return to the center or "POWER ON" position. The status in descent operation is DESCENT OPERATION PROGRAM:

Rung 1, I4 open, I5 closed, M1 not energized
Rung 2, I4 closed, I5 closed, M2 energized
Rung 3, I4 open, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 energized
Rung 8, M7 open
Rung 9, M6 closed, I7 closed
Rung 10, M3 open
Rung 11, I3 open, I8 closed, I7 closed, M7 not energized
Rung 12, M7 open, I7 closed
Rung 13, M6 closed, M11 closed, Q1 energized
Rung 14, Q1 closed, M3 closed, Q4 closed, Q3 energized
Rung 15, Q3 closed, T1 energized (timing)
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 closed
Rung 26, T2 open, M10 not energized
Rung 27, I7 open, Q4 open, M3 closed
Rung 28, I1 open, M11 closed, T4 closed
Rung 29, Q1 closed, T3 energized (timing)
Rung 30, M10 open, I8 closed, M12 closed, M11 not energized
Rung 31, M2 closed, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 closed
Rung 38, T4 open, I1 open, M12 not energized
Rung 39, M12 open The platen 21 will continue to be in the descent mode until its accumulated extend time is equal to the pre-set value of the extended value at which time the motor powering the ram 19 will stop and the electromagnetic interlock 78 will de-energize to unlock the loading door 31 for three seconds. The ladder logic program for this portion is COMPLETE MANUAL DESCENT OPERATION PROGRAM:

Rung 1, I4 open, I5 closed, M1 not energized
Rung 2, I4 closed, I5 closed, M2 energized
Rung 3, I4 open, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 energized
Rung 8, M7 open
Rung 9, M6 closed, I7 closed
Rung 10, M3 open
Rung 11, I3 open, I8 closed, I7 closed, M7 not energized
Rung 12, M7 open, I7 closed
Rung 13, M6 closed, M11 open, Q1 not energized
Rung 14, Q1 open, M3 closed, Q4 closed, Q3 not energized
Rung 15, Q3 closed, T1 energized (timed out), Q3 opens, T1 not energized
Rung 16, T1 closed, M9 (S) energized, T1 returns to open, M9 (S) not energized
Rung 17, I3 open
Rung 18, M10 open, M9 (R) energized
Rung 19, Q1 closed
Rung 20, Q1 open, M1 open, M9 closed, Q4 not energized, M9 returns to open
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 open, Q4 open, M3 closed
Rung 28, I1 open, M11 open, T4 closed
Rung 29, Q1 open, T3 not energized
Rung 30, M10 open, I8 closed, M12 closed, M11 energized
Rung 31, M2 closed, T1 closed, T1 returns to open
Rung 32, M11 closed, T4 closed, M12 closed
Rung 33, I8 closed, M3 open, I3 open
Rung 34, M11 open, Q2 not energized Rung 35, M11 closed, T4 energized (timing)

Rung 36, I8 closed, T4 open, I1 closed

Rung 37, I7 closed

Rung 38, T4 open, I1 open, M12 not energized

Rung 39, M12 open

Loading door opening mechanism opens the loading door 31 and after three seconds, the electromagnetic interlock 78 will re-energize. The status preparatory to opening the chamber door to tie the finished bale is as follows:

BEGIN MANUAL DOOR OPERATION

Rung 1, I4 open, I5 closed, M1 not energized

Rung 2, I4 closed, I5 closed, M2 energized

Rung 3, I4 open, I5 open, M3 not energized

Rung 4, M3 closed, I8 open, I1 closed, M4 not energized

Rung 5, M3 open, I8 closed

Rung 6, M4 open, M10 closed, T3 closed, M5 not energized

Rung 7, M5 open, I2 open, T4 closed, M6 not energized

Rung 8, M7 open

Rung 9, M6 open, I7 open

Rung 10, M3 open

Rung 11, I3 open, I8 open, I7 open, M7 not energized

Rung 12, M7 open, I7 open

Rung 13, M6 open, M11 closed, Q1 not energized

Rung 14, Q1 open, M3 closed, Q4 closed, Q3 not energized

Rung 15, Q3 open, T1 not energized

Rung 16, T1 open, M9 (S) not energized

Rung 17, I3 open

Rung 18, M10 open, M9 (R) energized

Rung 19, Q1 closed

Rung 20, Q1 open, M1 open, M9 open, Q4 not energized

Rung 21, Q4 open

Rung 22, M3 closed, M7 open

Rung 23, M3 open, I3 open

Rung 24, Q4 open, T2 not energized

Rung 25, M3 open, Q1 open

Rung 26, T2 open, M10 not energized

Rung 27, I7 closed, Q4 open, M3 closed

Rung 28, I1 open, M11 open, T4 closed, M11 returns to closed Rung 29, Q1 open, T3 not energized Rung 30, M10 open, I8 open, M12 closed, M11 not energized Rung 31, M2 closed, T1 open Rung 32, M11 open, T4 open, M12 closed, T4 returns to closed Rung 33, I8 open, M3 open, I3 open Rung 34, M11 closed, Q2 energized Rung 35, M11 open, T4 not energized (timed out)

Rung 36, I8 open, T4 closed, I1 closed, T4 returns to open

Rung 37, I7 open

Rung 38, T4 closed, I1 open, M12 not energized, T4 returns to open Rung 39, M12 open In preparation for removing a finished bale, the chamber door is opened and the finished bale is tied before instituting the "MANUAL UP" mode.

For operation of the baler control system in the "MANUAL UP" mode, the conditions for the initial set-up are:

Mode selector switch 71 is in the 60 degree UP position selecting "MANUAL UP".

The key switch 73 is in the center position for "POWER ON".

The stop button 75 is in the center position for normal operation.

The bale chamber door 33 is open and the finished bale is tied.

The platen 21 is extended to the top of the finished bale.

The loading door 31 is open.

The status of the ladder logic program then becomes:

MANUAL UP SET-UP PROGRAM

Rung 1, I4 closed, I5 open, M1 not energized

Rung 2, I4 open, I5 open, M2 not energized

Rung 3, I4 closed, I5 closed, M3 energized

Rung 4, M3 open, I8 open, I1 closed, M4 energized

Rung 5, M3 closed, I8 closed

Rung 6, M4 closed, M10 closed, T3 closed, M5 energized

Rung 7, M5 closed, I2 open, T4 closed, M6 not energized

Rung 8, M7 open

Rung 9, M6 open, I7 open

Rung 10, M3 closed

Rung 11, I3 open, I8 open, I7 open, M7 not energized

Rung 12, M7 open, I7 open

Rung 13, M6 open, M11 closed, Q1 not energized

Rung 14, Q1 open, M3 open, Q4 closed, Q3 not energized

Rung 15, Q3 open, T1 not energized

Rung 16, T1 open, M9 (S) not energized

Rung 17,I3 open

Rung 18, M10 open, M9 (R) energized

Rung 19, Q1 closed

Rung 20, Q1 open, M1 open, M9 open, Q4 not energized

Rung 21, Q4 open

Rung 22, M3 open, M7 open

Rung 23, M3 closed, I3 open

Rung 24, Q4 open, T2 not energized

Rung 25, M3 closed, Q1 open

Rung 26, T2 open, M10 not energized

Rung 27, I7 closed, Q4 open, M3 open

Rung 28, I1 open, M11 closed, T4 closed

Rung 29, Q1 open, T3 not energized

Rung 30, M10 open, I8 open, M12 closed, M11 not energized

Rung 31, M2 open, T1 open

Rung 32, M11 open, T4 closed, M12 closed

Rung 33, I8 open, M3 closed, I3 open

Rung 34, M11 closed, Q2 energized

Rung 35, M11 open, T4 not energized

Rung 36, I8 open, T4 open, I1 closed

Rung 37, I7 open

Rung 38, T4 open, I1 open, M12 not energized

Rung 39, M12 open

The "MANUAL UP" operation, which also causes ejection apparatus (described elsewhere) to eject the finished bale from the baler, is initiated by the key switch 73 being turned to the right ("START") position. The motor starter 90 will then start the motor but the platen 21 will not move. The status for the ladder logic program will be:

MANUAL UP STOP OPERATION PROGRAM

Rung 1, I4 closed, I5 open, M1 not energized

Rung 2, I4 open, I5 open, M2 not energized

Rung 3, I4 closed, I5 closed, M3 energized

Rung 4, M3 open, I8 open, I1 closed, M4 energized
Rung 5, M3 closed, I8 closed
Rung 6, M4 closed, M10 closed, T3 closed, M5 energized
Rung 7, M5 closed, I2 closed, T4 closed, M6 energized
Rung 8, M7 open
Rung 9, M6 closed, I7 open
Rung 10, M3 closed
Rung 11, I3 open, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 open, M7 open
Rung 23, M3 closed, I3 open
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open When the key switch 73 is released to return to the center or "POWER ON" position, the controller is ready for manual raising of the platen and the status of the ladder logic program is:

MANUAL UP READY PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M4 closed, I2 open, T4 closed, M6 energized
Rung 8, M7 open
Rung 9, M6 closed, I7 open
Rung 10, M3 closed
Rung 11, I3 open, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 open, M7 open
Rung 23, M3 closed, I3 open
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open In order to raise the platen causing the finished bale to eject, an operator must be at the control panel on the side of the baler where the operator is out of the path of the ejected bale and is in a position to see that the ejection of the bale onto an appropriate carrier is provided for in a safe manner. The operator must pull out on the (STOP/PULL TO/RAISE) stop button 75 causing the platen to retract only as long as the operator continues to hold out on the stop/pull to/raise button. For the platen to raise, the ladder logic program has the following status:

MANUAL UP RAISE PLATEN OPERATION PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M5 closed, I2 open, T4 closed, M6 energized
Rung 8, M7 open
Rung 9, M6 closed, I7 open
Rung 10, M3 closed
Rung 11, I3 closed, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) energized
Rung 17, I3 closed
Rung 18, M10 open, M9 (R) not energized
Rung 19, Q1 open
Rung 20, Q1 closed, M1 open, M9 closed, Q4 energized
Rung 21, Q4 open Rung 22, M3 open, M7 open
Rung 23, M3 closed, I3 closed
Rung 24, Q4 open, T2 energized (timing)
Rung 25, M3 closed, Q1 closed
Rung 26, T2 open, M10 not energized
Rung 27,I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, 13 closed
Rung 34, M11 closed, Q2 energized
Rung 35, M11 open, T4 not energized
Rung 36, I8 open, T4 open, I1 closed
Rung 37,I7 open
Rung 38, T4 open, I1 open, M12 not energized
Rung 39, M12 open If the button is released, the platen will stop and the status of the ladder logic program will be:

STOP PLATEN RAISE OPERATION PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M5 closed, I2 open, T4 closed, M6 energized
Rung 8, M7 open
Rung 9, M6 closed, I7 open
Rung 10, M3 closed
Rung 11, I3 open, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) not energized
Rung 17, I3 open
Rung 18, M10 open, M9 (R) not energized
Rung 19, Q1 open
Rung 20, Q1 closed, M1 open, M9 closed, Q4 not energized
Rung 21, Q4 open
Rung 22, M3 open, M7 open
Rung 23, M3 closed, I3 open
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open When the accumulated retract time is equal to the reset value in the retract timer, the motor powering ram 19 will stop concluding the "MANUAL UP" operation. The status of the ladder logic program will be:

MANUAL UP END OPERATION PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 open, T3 closed, M5 not energized, M10 returns to closed
Rung 7, M5 open, I2 open, T4 closed, M6 not energized
Rung 8, M7 open
Rung 9, M6 open, I7 open
Rung 10, M3 closed
Rung I1, I3 open, I8 open, I7 open, M7 not energized
Rung 12, M7 open, I7 open
Rung 13, M6 open, M11 closed, Q1 not energized
Rung 14, Q1 open, M3 open, Q4 closed, Q3 not energized
Rung 15, Q3 open, T1 not energized
Rung 16, T1 open, M9 (S) not energized
Rung 17, I3 open
Rung 18, M10 closed, M9 (R) energized, M10 returns to open
Rung 19, Q1 closed
Rung 20, Q1 open, M1 open, M9 open, Q4 not energized
Rung 21, Q4 open
Rung 22, M3 open, M7 open
Rung 23, M3 closed, I3 open
Rung 24, Q4 open, T2 not energized (timed out)
Rung 25, M3 closed, Q1 open
Rung 26, T2 closed, M10 energized, T2 returns to open, M10 not energized
Rung 27,I7 closed, Q4 open, M3 open
Rung 28, I1 open, M11 closed, T4 closed
Rung 29, Q1 open, T3 not energized
Rung 30, M10 closed, I8 open, M12 closed, M11 not energized, M10 returns to open
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open When the operator has followed the procedures above, the finished bale should be ejected completing the "MANUAL UP" operation and concluding the cycle so that the "AUTO" mode can be initiated again as described above.

Figure 5:
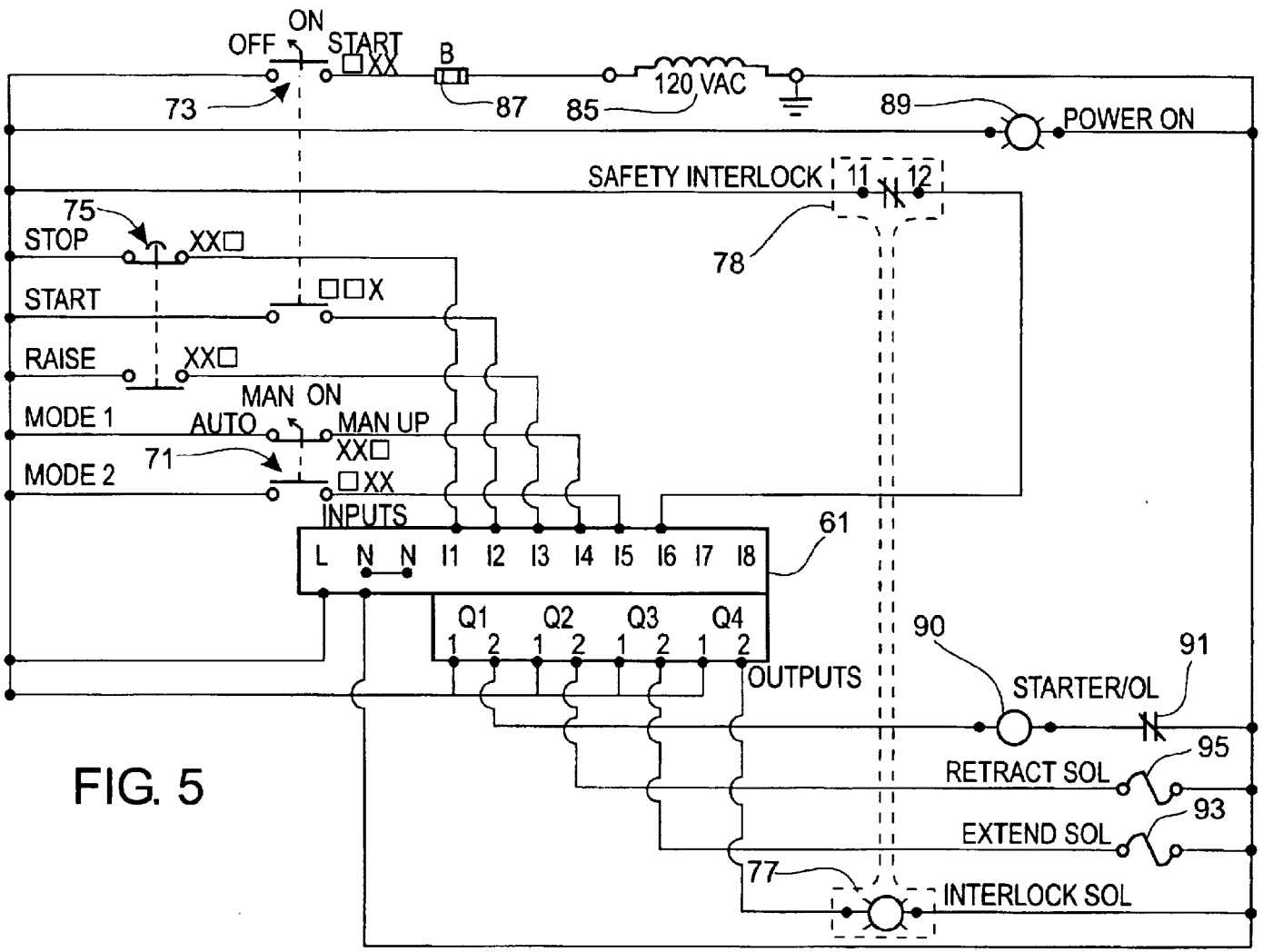
FIG. 5 is a schematic circuit diagram showing connections of the programmable relay and other electrical components of the baler of FIGS. 1, 2, and 3.

FIG. 5 is a schematic circuit diagram showing the hard wired connections of the programmable relay with other electrical components of the baler of FIGS. 1 and 2. Programmable relay 61 is the part of the controller for the baler and is a conventional solid-state electronics device readily available and well known as indicated by the referenced patents.

Electrical outputs of programmable relay 61 are labeled Q1, Q2, Q3, and Q4. Output Q1 supplies a control signal to motor starter 90 for the motor powering hydraulic ram 19 for raising and lowering platen 21 (ram 19 and platen 21 being shown in FIG. 1). An overload protector 91 is shown in circuit with motor starter 90.

Output Q4 controls the interlock solenoid shown schematically at 77. Output Q3 controls the hydraulic extend valve solenoid shown schematically at 93 and output Q2 controls the hydraulic retract valve solenoid shown schematically at 95.

Programmable relay 61 is provided with power terminals L and N receiving AC power from transformer secondary 85 having a fuse 87 in series therewith for protection thereof As shown at 73, off/on/start key switch is configured to provide power from transformer secondary 85 to all elements of the circuit of FIG. 5 in all positions except the off position. Power on condition is indicated by power on light 89. The three-phase power system for the motor of hydraulic ram 19 is conventional and not shown in detail.

Safety interlock switch 81 is connected to Input 6. Mode select switch 71 is connected to Inputs 4 and 5, being closed to both at the center position.

The off/on/start key switch 73 also has a contact and connection to Input 2. The pull to raise/stop button 75 has contacts connecting input 3 and 4 respectively.

Other operation features may not be readily apparent from the foregoing description. They include the following.

If the stop button is pushed in while the motor is on and if the loading door is closed, the motor will stop and the electromagnetic interlock will de-energize to unlock the loading door. The loading door opening mechanism will open the loading door as it does whenever the electromagnetic interlock is de-energized. The magnetic door interlock will remain un-energized for three seconds and then re-energize.

If the stop button is pushed in while the motor is off and if the loading door is closed, the electromagnetic interlock will de-energize to unlock the loading door. The loading door opening mechanism will open the loading door. The electromagnetic interlock will remain un-energized for three seconds and then re-energize.

If the key switch is moved to the "off" position, all control voltage is off and there is no power to the programmable relay.

If the stop/pull to raise button is pulled out while the motor is running, and if the platen is extended and if the loading door is closed, the platen will shift direction and retract until the accumulated retract time is equal to the preset value in the retract timer. The motor then will stop and the electromagnetic interlock will de-energize to unlock the loading door. The loading door opening mechanism will open the loading door. The electromagnetic interlock will remain un-energized for three seconds and then re-energize.

If the stop/pull to raise button is pulled out while the motor is off and if the key switch is in the "POWER ON" position and if the platen is extended and if the loading door is closed, the motor will start and the platen will retract until the accumulated retract time is equal to the preset value in the retract timer. The motor will stop and the electromagnetic interlock will be energized to unlock the loading door. The loading door opening mechanism will open the loading door. The electromagnetic interlock will remain un-energized for three seconds and then re-energized.

From the foregoing discussion, it will be seen that the control circuit and the programmable relay provide for both expected and unexpected operator actions at the control panel thereby preventing problems with a control system function that could require supervisory activity beyond the operator's ability.

From FIGS. 1, 2, 3, 4A–E, and 5 it will be seen that the control system of the programmable relay and associated components serve to effectively provide all of the functions of the baler including waste acceptance, compaction, and bale ejection in a safe and efficient manner with a minimum of complexity using a relatively small number of interlocking and locking devices.

While the control program and circuit described above is explained in relation to cooperation with a particular form of bale dump tray and ejection mechanism coupling the bale dump tray and the baler platen, its usefulness is not limited to this particular form of baler and ejection mechanism but is suitable with or adaptable to other forms of compaction apparatus.

In addition to the alternative forms of implementation of the apparatus shown, suggested, or described above, it will be apparent to those skilled in the art that other modifications and variations to the apparatus can be employed and accordingly the scope of the invention is not to be limited to the variations explicitly described but is rather to be determined by reference to the appended claims.

What is claimed is:

1. In a waste compactor having a waste chamber with a front and a back, a hydraulic ram powered by an electric motor, a platen retracted and extended by said ram, a loading door and an unloading opening, a dump tray, and a chamber door on said front of said chamber, compaction and ejection control apparatus comprising:

a plurality of relays having a plurality of inputs and a plurality of outputs;

an electromagnetic interlock and sensor switch arranged to interlock said loading door and said chamber door;

an off/on/start switch;

a mode select switch;

at least one control switch having raise contacts, and start contacts;

a retract solenoid;

an extend solenoid;

an interlock solenoid connected to said electromagnetic interlock; and a motor starter;

each respective one of said switches being connected to a respective one of said inputs and each one of said solenoids and said starter being connected to one of said outputs;

said plurality of relays being interconnected to prevent hazardous baler operations including undesired ram extension or retraction when either of said chamber door or loading door is improperly positioned for such operation, and undesired continued ram operation in certain of selected modes if the operator does not have manual contact with said control switch.

2. Apparatus as recited in claim 1 wherein said electric motor is a three-phase electric motor and said motor starter is a three-phase motor starter.

3. Apparatus as recited in claim 2 wherein said waste compactor includes a dump mechanism and a dump link configured to selectively connect said dump mechanism to said platen.

4. Apparatus as recited in claim 1 wherein said control switch is biased to require sustained operator action to continue raise platen action.

5. In a waste compactor baler having a waste chamber with a front and a back, a hydraulic ram powered by an electric motor, a platen retracted and extended by said ram, a loading door and an unloading opening, a dump tray, a dump control link, and a chamber door on said front of said chamber, compaction and ejection control apparatus comprising:

a programmable relay having a plurality of inputs and a plurality of outputs;

an electromagnetic interlock and sensor switch arranged to interlock said loading door with said chamber door;

an off/on/start key switch;

a mode select switch;

at least one control switch having raise contacts, start contacts, and stop contacts;

a retract solenoid;

an extend solenoid;

an interlock solenoid connected to said electromagnetic interlock; and a motor starter;

each respective one of said switches being connected to a respective one of said inputs and each one of said solenoids and said starter being connected to one of said outputs;

said dump control link being configured to selectively engage said dump tray with said platen if said chamber door is not in the closed position thereby causing said dump tray to be linked to said platen so that upward motion of said platen causes partially rotational movement of said dump tray to eject a bale only when said chamber door is not closed;

said programmable relay being programmed to prevent hazardous baler operations including undesired ram extension or retraction when either of said chamber door or loading door is improperly positioned for such operation, and undesired continued ram operation in certain of selected modes if the operator does not have manual contact with said control switch.

6. Apparatus as recited in claim 5 wherein said electric motor is a three-phase electric motor and said motor starter is a three-phase motor starter.

7. Apparatus as recited in claim 5 wherein said control switch is biased to require sustained operator action to continue raise platen action.

8. Apparatus as recited in claim 6 wherein said control switch is biased to require sustained operator action to continue raise platen action.

9. Apparatus as recited in claim 5 wherein said control link is a mechanical connecting element for said dump tray which is moved out of connecting relation by closing of said chamber door.

10. In a waste compactor vertical baler having a bale chamber with a front and a back, a hydraulic ram powered by an electric motor, a platen raised and lowered by said ram, a loading door and an unloading opening, a dump tray, a dump control link, and a chamber door on said front of said chamber, a compaction and ejection control apparatus comprising:

a programmable relay having a plurality of inputs and a plurality of outputs;

an electromagnetic interlock and sensor switch arranged to interlock said loading door with said chamber door;

an off/on/start key switch;

a mode selector switch having multiple contacts at least one control switch having raise contacts, start contacts, and stop contacts;

a retract solenoid;

an extend solenoid;

an interlock solenoid, and a motor starter;

each respective ones of said switches being connected to a respective one of said inputs and each one of said solenoids and said starter being connected to one of said outputs;

said dump control link being configured to selectively engage said dump tray with said platen if said chamber door is not in the closed position thereby causing said dump tray to be linked to said platen so that upward motion of said platen causes partially rotational movement of said dump tray to eject a bale only when said chamber door is not closed;

said programmable relay being programmed to prevent hazardous baler control operations including undesired ram extension or retraction when either of said chamber door or loading door is improperly positioned for such operation, and undesired continued ram operation in certain of selected modes if the operator does not have manual contact with said control switch.

11. Apparatus as recited in claim 10 wherein said electric motor is a three-phase electric motor and said motor starter is a three-phase motor starter.

12. Apparatus as recited in claim 10 wherein said control switch is biased to require sustained operator action to continue raise platen action.

13. Apparatus as recited in claim 11 wherein said control switch is biased to require sustained operator action to continue raise platen action.

14. Apparatus as recited in claim 10 wherein said control link is a mechanical connecting element for said dump tray which is moved out of connecting relation by closing of said chamber door.

15. Apparatus as recited in claim 13 wherein said control link is a mechanical connecting element for said dump tray which is moved out of connecting relation by closing of said chamber door.

* * * * *